United States Patent [19]

McClelland

[11] Patent Number: 4,933,993

[45] Date of Patent: Jun. 19, 1990

[54] PROTECTIVE MASK

[76] Inventor: J. B. McClelland, R.R. 1, Treasure Island, Kingston, Ontario, Canada, K7L 4V1

[21] Appl. No.: 303,852

[22] Filed: Jan. 30, 1989

[51] Int. Cl.[5] ..... A63B 71/10; A42B 3/00

[52] U.S. Cl. ..... 2/424; 2/9; 2/425

[58] Field of Search ..... 2/9, 421, 424, 426, 2/427, 10, 425

[56] References Cited

U.S. PATENT DOCUMENTS

| | | | |
|---|---|---|---|
| 1,178,313 | 4/1916 | Goodman | 2/9 |
| 2,100,553 | 11/1937 | Schutt | 2/9 |
| 3,067,427 | 12/1962 | McClintock, Sr. | 2/9 |
| 3,139,624 | 3/1963 | Humphrey | 2/9 |
| 3,167,783 | 6/1963 | Wolfe | 2/9 |
| 3,196,458 | 7/1965 | Keith | 2/9 |
| 3,263,236 | 9/1964 | Humphrey | 2/9 |
| 3,686,690 | 8/1972 | Webb | 2/9 |
| 3,729,746 | 5/1973 | Humphrey | 2/9 |
| 3,751,728 | 8/1973 | Thompkins | 2/3 R |
| 3,854,146 | 12/1974 | Dunning | 2/9 |
| 4,028,743 | 6/1977 | Christensen | 2/424 |
| 4,031,564 | 6/1977 | Wood | 2/9 |
| 4,086,664 | 5/1978 | Humphrey et al. | 2/9 |
| 4,168,542 | 9/1979 | Small | 2/9 |
| 4,233,687 | 11/1980 | Lancellotti | 2/9 |
| 4,342,122 | 8/1982 | Abraham et al. | 2/424 |
| 4,370,759 | 2/1983 | Zide | 2/424 |
| 4,390,995 | 7/1983 | Walck | 2/9 |
| 4,594,737 | 6/1986 | Butash | 2/424 |
| 4,631,758 | 12/1986 | Newman et al. | 2/424 |
| 4,633,531 | 1/1987 | Nimmons | 2/424 |
| 4,689,835 | 9/1987 | Draft et al. | 2/424 |
| 4,692,947 | 9/1987 | Black et al. | 2/421 |

*Primary Examiner*—Peter Nerbun
*Assistant Examiner*—D. Price
*Attorney, Agent, or Firm*—Weingarten, Schurgin, Gagnebin & Hayes

[57] ABSTRACT

A protective helmet is provided with a detachable wire face guard firmly secured in protective relation to the sides and peak of the helmet in mutual reinforcing relation therewith. The lightweight, fully ventilated mask affords a high degree of protection, with a wide, substantially unobstructed field of view, and is well suited for use by game playing youngsters such as those playing in the Little Leagues. A close coupled upper beam portion of the mask positioned, in use, above the normal field of vision of a user has a plurality of stiffening web members extending between upper and lower chord members of the upper beam portion of the mask. A mask lower beam portion is spaced downwardly from the upper beam portion in relatively inclined relation thereto and defining in use a major visual field therebetween, being spaced apart a distance sufficient to prevent substantial ingress of a predetermined standard sized object such as a baseball therebetween. Web portions of the lower, face protective portion of the mask are downwardly and rearwardly inclined in angled relation relative to the upper beam portion of the mask, to afford significant frontal stiffening to the lower beam portion.

16 Claims, 2 Drawing Sheets

PROTECTIVE MASK

FIELD OF THE INVENTION

This invention is directed to an improved face mask and in particular to a face mask in combination with a protective helmet.

BACKGROUND OF THE INVENTION

The use of protective helmets is widespread as in organized games of baseball and the like, the helmets frequently being of the type having a molded plastic shell, with a protective frontal peak serving also as an eye shade.

One earlier approach to the use of a protective face mask with a protective helmet, used by both adults and by juvenile Little Leaguers has been a clear plastic wrap around shield of high impact polycarbonate, enclosing the middle and lower portion of the wearers face, and being cantilevered forwardly from the helmet ear flags. This is illustrated in U.S. Pat. No. 3,886,596 June 3, 1975 FRANKLIN et al.

This earlier arrangement suffers the disadvantages of being a somewhat high cost item, and of forming an enclosure with certain depressive psychological overtones. More importantly it is though that the degree of mechanical protection for the frontal forehead zone of the wearer could be significantly improved, in view of a susceptability of the helmet peak to buckle or deflect under impact.

The use of face guards, as in sports is well developed and widespread, for motor racing, football, ice hockey and baseball, as evidenced in the following listed United States patents. These patents include the use of wire masks, the following first listed patent, of McClintock, Sr., being to a mask used with a peaked helmet; the substantial remainder comprise of wire masks for football helmets:

| | | |
|---|---|---|
| 3067427 | Dec. 1962 | McClintock Sr. |
| 3139624 | July 1964 | Humphrey |
| 3167783 | Feb. 1965 | Wolfe |
| 3263236 | Aug. 1966 | Humphrey |
| 3686690 | Aug. 1972 | Webb |
| 3729746 | May 1973 | Humphrey |
| 3751728 | Aug. 1973 | Thomkins |
| 3854146 | Dec. 1974 | Dunning |
| 4086664 | May 1978 | Humphrey et al |
| 4233687 | Nov. 1980 | Lancellotti |
| 4342122 | Aug. 1982 | Abraham |
| 4370759 | Feb. 1983 | Zide |
| 4390995 | July 1983 | Walck |
| 4594737 | June 1986 | Butash |
| 4631758 | Dec. 1986 | Newman et al |
| 4633531 | Jan. 1987 | Nimmons |
| 4689835 | Sep. 1987 | Draft |
| 4692947 | Sep. 1987 | Black et al |

SUMMARY OF THE INVENTION

The present invention provides a unitary mask for use in combination with a protective helmet having a forwardly protruding peak or brim.

In the preferred embodiment of the invention the mask is attached to the helmet in close-coupled mutually supportive attached supporting relation with the brim portion of the helmet. The preferred embodiment is fabricated of plastic covered wire.

The present invention provides an arcuate frontal mask for attachment to a helmet, having lateral attachment means adjacent the ends of the mask, for securement to the sides of the helmet, and attachment means for securing a central portion of the mask to the helmet brim.

The mask incorporates a substantially rigid first, upper beam structure portion. The first beam portion comprises upper and lower chord members, with stiffening web means extending downwardly in joining relation between the chord members, intermediate their ends.

In the preferred embodiment the central mask attachment means comprises a pair of screws with associated socket nuts, and clips in mutual closely spaced relation, securing the mask central portion to the undersurface of the helmet brim, the clips being detachable plastic clips which each wrap the upper chord member of the mask.

The mask upper beam stiffening web means includes at least one, and preferably a plurality of reinforcement element portions attached to the upper and lower chord members, extending substantially at right angles in mutually spaced relation therebetween. In one embodiment the reinforcement element portions comprise u-shaped portions attached top and bottom to the chord members.

The mask further includes a lower protective second portion having an upper and a lower chord member, with at least one preferably a plurality of mutually spaced reinforcing web portions connecting in joining relation between the upper and lower chord members of the second protective portion.

The mask second portion is positioned, in use, in protective proximity to the lower portion of the face of a wearer, in suspended relation from the first beam portion.

The lower chord member of the first, upper beam extends in near parallel relation with the upper chord member of the second, lower beam.

The lower protective second portion of the mask is supported in cantilevered relation adjacent the ends thereof in downwardly spaced relation from the respective outer ends of the mask upper beam portion. A pair of intermediate bracing members bounding the primary field of vision interconnect the four chord members in mutual bracing relation.

The use of the term wire in the present disclosure refers generally to a ferrous based metal wire of about size 14 Standard Wire Gauge (SWG), generally having a tough plastic coating thereover. However, this term extends to include material of equivalent or greater mechanical strength, toughness and at least equal stiffness, capable of withstanding the required impact duty. It is contemplated that injection molded plastic construction may be used.

In a preferred embodiment the mask has an upper beam portion, having web means comprising three u-shaped web members extending in mutual laterally spaced bracing relation between the lower and the upper chord members thereof; the lower beam portion has a pair of inverted u-shaped web members with adjacent leg portions thereof in laterally joined relation, the web members being downwardly and rearwardly inclined, to afford triangulated stiffening to the lower beam portion.

The present invention thus provides a protective, unitary face mask for use with a batter's helmet having a forwardly protruding brim portion, the mask comprising an arrangement of connecting slender elements having an arcuate frontal portion for attachment in mutual supporting relation with the helmet, the mask having a peripheral frame portion, intermediate chord members extending laterally of the frame to constitute an upper beam portion and a lower beam portion, a pair of tie members extending between the beam portions intermediate the ends of the beam portions and defining therewith a major field of vision for a wearer of the mask, and reinforced web means extending between the respective chord members in beam forming relation therewith.

BRIEF DESCRIPTION OF THE DRAWING

Certain embodiments of the invention are described by way of illustration, and without limiting of the invention thereto, references being made to the accompanying drawings, wherein.

DETAILED DESCRIPTION OF THE INVENTION

Figure 1:
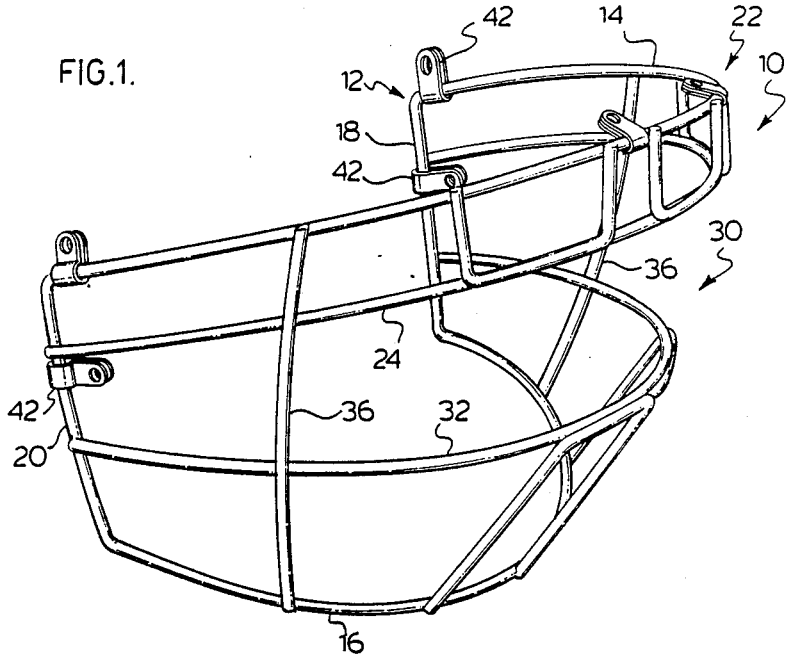
FIG. 1 is a perspective view looking downward on a mask in accordance with the present invention.
Figure 2:
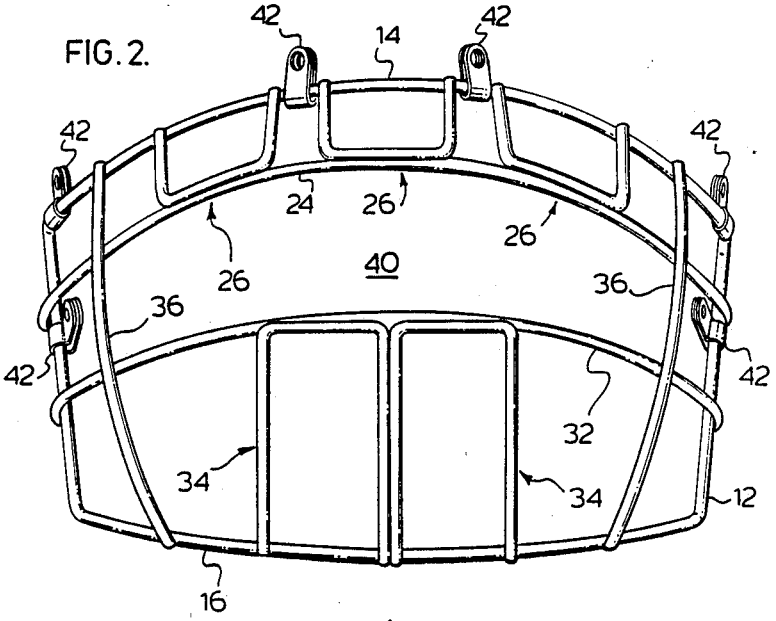
FIG. 2 is a frontal elevation of the mask of FIG. 1.
Figure 3:
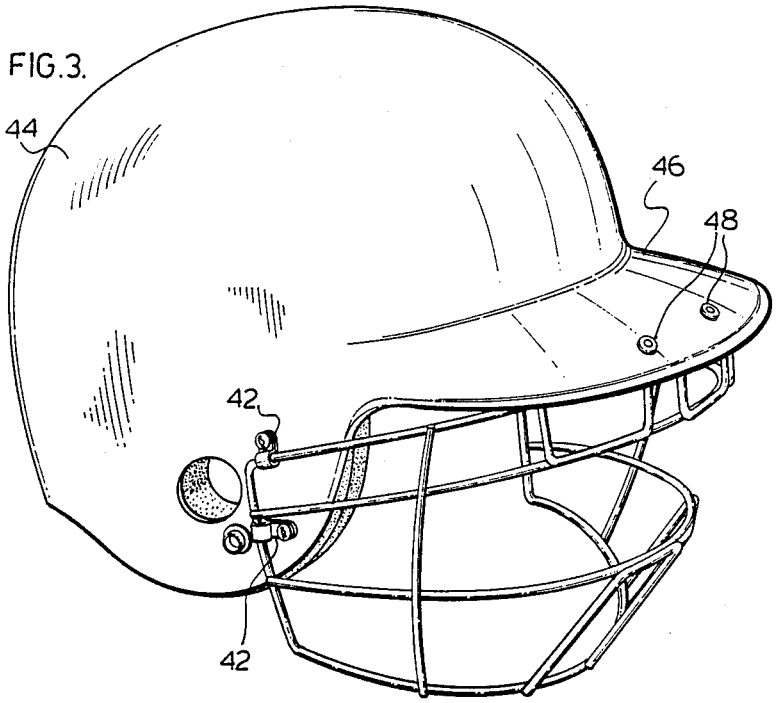
FIG. 3 is a side elevation of a baseball helmet having the mask secured thereto.
Figure 4:
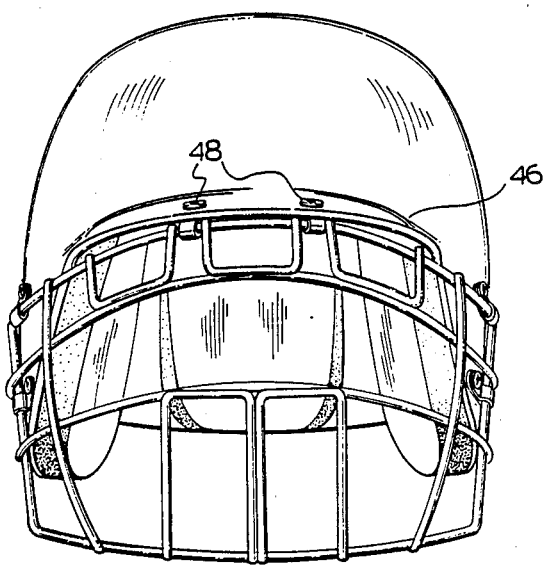
FIG. 4 is a frontal elevation of the arrangement of FIG. 3.

Referring to the drawings, the mask 10 has a peripheral frame portion 12 comprising top chord 14, bottom chord 16 and side portions 18, 20.

A first, upper beam portion 22 comprises the top chord member 14, a lower chord member 24, and intermediate web portion comprising u-shaped members 26. A second, lower beam portion 30 comprises bottom chord 16, an upper chord member 32 and intermediate web portions comprising u-shaped member 34, which are illustrated as being inverted. A pair of brace tie members 36 interconnect all of the chord members 14, 24, 32 and 16 in mutual bracing relation, serving also as respective web portions for the upper beam portion 22 and the lower beam portion 30.

The aperture 40 bounded by members 24, 32 and 36 constitutes a primary field of vision. The adjacent apertures of the mask bounding the aperture 40 may comprise secondary, peripheral vision areas. However, the primary field provides an excellent field of vision for most purposes.

The aperture 40 may be particularly sized to effectively block penetration of a standard sized baseball therein.

The respective web portions of the upper and lower beam portions 22, 30 together with tie members 36 stiffen the respective beam portions while precluding any spreading between adjacent chord members. The tie members 36 and web portion 26, 34 are located outside the portion 14, 16 of frame 12 and chords 24, 32, to better withstand impact thereagainst. This arrangement also facilitates assembly and welding of the mask components, when fabricated of wire, prior to coating thereof, generally with a tough plastic protective coat such as polyvinylchloride.

It is contemplated that the mask 12 may be die cast in heavy duty high impact plastic.

The mask 12 is provided with plastic attachment clips 42 located in securing relation with the upper beam portion 22. Owing to the curved shape of the mask 10 the few clips provide secure, rigid attachment of mask 10 to the helmet 44.

What is claimed:

1. A protective unitary face mask for use with a protective helmet having a forwardly protruding brim portion, said mask comprising an arrangement of connecting slender elements, having an arcuate frontal portion for attachment to said helmet; first, lateral attachment means secured adjacent opposed lateral ends of the mask, for securement of the mask to the sides of the helmet; said frontal portion comprising laterally extending, substantially rigid, arcuately curved upper beam means connecting with said lateral attachment means, and shaped in substantially conforming relation with a portion of said brim, second attachment means for securing said upper beam means to said brim portion intermediate the ends thereof in mutual reinforcing supporting relation therewith; and lower face protective means located a predetermined distance beneath the upper beam means and being suspended therefrom to define a protected major field of vision.

2. The mask as set forth in claim 1, said upper beam means having an upper chord member; a lower chord member adjacent thereto, and intermediate web means in secured relation therebetween.

3. The mask as set forth in claim 2, said upper chord member of said upper beam means extending substantially beneath said helmet brim portion in secured supporting relation therewith.

4. The face mask as set forth in claim 2, said lower face protective means comprising laterally extending substantially rigid, arcuate lower beam means having an upper chord member, a lower chord member and intermediate web means secured in mutual bracing relation between said upper and said lower chord members; said lower chord member of said upper beam means and said upper chord member of said lower beam means extending in predetermined mutually spaced relation defining said substantially unobstructed major visual field therebetween, of predetermined height to preclude damaging penetration of an object of predetermined size therein.

5. A protective unitary face mask for use in a protective helmet having a forwardly protruding brim portion, said mask comprising an arrangement of connecting slender elements, having an arcuate frontal portion for attachment to said helmet, with laterally extending, substantially rigid curved upper beam means connecting at its ends with first lateral attachment means, for securement to the sides of the helmet, second attachment means for securing said upper beam means to said brim portion intermediate the ends thereof in mutual supporting relation therewith; said upper beam means having an upper chord member; a lower chord member adjacent thereto, and intermediate web means in secured relation therebetween, lower face protective means comprising laterally extending substantially rigid, arcuate lower beam means having an upper chord member, a lower chord member and intermediate web means secured in mutual bracing relation therebetween; said lower beam means being substantially rigidly suspended adjacent the ends thereof in cantilevered relation from said upper beam member said lower chord member of said upper beam means and said upper chord member of said lower beam means extending in predetermined mutually spaced relation defining a substantially unobstructed major visual field therebetween, of predetermined height to preclude damaging penetration of an object of predetermined size therein.

6. The face mask as set forth in claim 4, said major visual field being bounded laterally at the sides of the mask by bracing means extending in tying relation between said upper and said lower chord members.

7. The face mask as set forth in claim 4, said upper beam means extending when worn by a user in installed relation on said helmet in substantially parallel relation with the forehead of the user.

8. The face mask as set forth in claim 1, for use with a base ball helmet.

9. The face mask as set forth in claim 5, in combination with said protective helmet.

10. The face mask as set forth in claim 7, said lower beam means projecting downwardly in rearwardly inclined relation from said upper chord member thereof, said lower beam intermediate web means comprising members extending upwardly in forwardly inclined supporting relation with said upper chord member, in forwardly inclined stiffening relation therewith, in use to resist the impact of a baseball thereagainst.

11. The face mask as set forth in claim 5 in combination with said helmet.

12. The face mask as set forth in claim 5, said upper beam web means comprising at least one u-shaped member secured in tying relation between said upper and said lower chord means of said upper beam.

13. The face mask as set forth in claim 13, having three said u-shaped members arranged in symmetrically spaced relation about said curved upper beam.

14. The face mask as set forth in claim 5, said intermediate web means of said lower beam comprising at least one u-shaped member.

15. The face mask as set forth in claim 13, said intermediate web means comprising a pair of said u-shaped members.

16. The face mask as set forth in claim 15, said pair of u-shaped members having inner leg portions thereof in substantial abutting relation along the length thereof, located substantially centrally of said mask.

* * * * *

UNITED STATES PATENT AND TRADEMARK OFFICE

CERTIFICATE OF CORRECTION

PATENT NO. : 4,933,993

DATED : June 19, 1990

INVENTOR(S) : J.B. McClelland

It is certified that error appears in the above-identified patent and that said Letters Patent is hereby corrected as shown below:

After the Abstract, "16 Claims, 2 Drawing Sheets" should read --17 Claims, 2 Drawing Sheets--.

Column 3, line 8, "reinforced" should read --reinforcing--.

Column 3, line 15, "references" should read --reference--.

Column 3, line 35, "member 34" should read --members 34--.

Column 4, line 60, "upper beam member" should read --upper beam means--.

Column 6, line 7, "claim 13" should read --claim 12--.

After claim 16, the following claim should be inserted:

17. The face mask as set forth in claim 4 in combination with said helmet.

Signed and Sealed this

Twenty-seventh Day of October, 1992

*Attest:*

DOUGLAS B. COMER

*Attesting Officer*

*Acting Commissioner of Patents and Trademarks*